US008408331B2

(12) United States Patent
Patwa et al.

(10) Patent No.: US 8,408,331 B2
(45) **Date of Patent: *Apr. 2, 2013**

(54) DOWNHOLE DOWNLINKING SYSTEM EMPLOYING A DIFFERENTIAL PRESSURE TRANSDUCER

(75) Inventors: Ruchir S. Patwa, Houston, TX (US); Pralay Das, Sugar Land, TX (US); Junichi Sugiura, Bristol (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 368 days.

This patent is subject to a terminal disclaimer.

(21) Appl. No.: 12/684,205

(22) Filed: Jan. 8, 2010

(65) Prior Publication Data

US 2011/0168445 A1 Jul. 14, 2011

(51) Int. Cl.
*E21B 21/08* (2006.01)

(52) U.S. Cl. ..... 175/48; 175/38; 73/152.22

(58) Field of Classification Search ..... 175/48, 175/50, 38; 73/152.22; 367/83
See application file for complete search history.

(56) References Cited

U.S. PATENT DOCUMENTS

| | | | | |
|---|---|---|---|---|
| 3,298,449 | A | 1/1967 | Bachman et al. | |
| 4,297,880 | A * | 11/1981 | Berger | 73/152.22 |
| 4,354,233 | A | 10/1982 | Zhukovsky et al. | |
| 4,655,299 | A | 4/1987 | Schoeffler | |
| 4,805,449 | A * | 2/1989 | Das | 73/152.48 |
| 4,903,245 | A | 2/1990 | Close et al. | |
| 5,065,825 | A | 11/1991 | Bardin et al. | |
| 5,603,386 | A | 2/1997 | Webster | |
| 6,021,377 | A | 2/2000 | Dubinsky et al. | |
| 6,206,108 | B1 * | 3/2001 | MacDonald et al. | 175/24 |
| 6,267,185 | B1 | 7/2001 | Mougel et al. | |
| 6,655,452 | B2 * | 12/2003 | Zillinger | 166/66 |
| 6,662,110 | B1 | 12/2003 | Bargach et al. | |
| 6,920,085 | B2 | 7/2005 | Finke et al. | |
| 6,997,272 | B2 | 2/2006 | Eppink | |
| 7,114,579 | B2 | 10/2006 | Hutchinson | |
| 7,142,986 | B2 | 11/2006 | Moran | |
| 7,172,037 | B2 | 2/2007 | Dashevskiy et al. | |
| 7,222,681 | B2 | 5/2007 | Jones et al. | |
| 7,224,288 | B2 | 5/2007 | Hall et al. | |

(Continued)

FOREIGN PATENT DOCUMENTS

| | | |
|---|---|---|
| GB | 2172324 | 7/1986 |
| GB | 2177738 | 1/1987 |

(Continued)

OTHER PUBLICATIONS

International Search Report and Written Opinion of PCT Application No. PCT/US2011/020632 dated Aug. 2, 2011.

(Continued)

*Primary Examiner* — Giovanna Wright
(74) *Attorney, Agent, or Firm* — Christopher C. Streinz; Kimberly Ballew

(57) ABSTRACT

A downhole tool includes a downlinking system deployed in a downhole tool body having an internal through bore. The downlinking system includes a differential pressure transducer configured to measured a pressure difference between drilling fluid in the internal through bore and drilling fluid external to the tool (in the borehole annulus). The differential transducer is electrically connected with an electronic controller (deployed substantially anywhere in the drill string) that is configured to receive and decode pressure waveforms.

18 Claims, 8 Drawing Sheets

U.S. PATENT DOCUMENTS

| | | | | |
|---|---|---|---|---|
| 7,245,229 | B2 | 7/2007 | Baron et al. | |
| 7,489,591 | B2 | 2/2009 | Mumby | |
| 7,721,822 | B2 | 5/2010 | Krueger et al. | |
| 2004/0217879 | A1 | 11/2004 | Guggari | |
| 2005/0001737 | A1 | 1/2005 | Baron et al. | |
| 2011/0286308 | A1* | 11/2011 | Sugiura | 367/83 |
| 2011/0286309 | A1* | 11/2011 | Sugiura | 367/83 |

FOREIGN PATENT DOCUMENTS

| | | | |
|---|---|---|---|
| GB | 2282165 | | 3/1995 |
| GB | 2356207 | A | 5/2001 |
| GB | 2358651 | A | 8/2001 |
| WO | 9007625 | | 7/1990 |
| WO | 9008245 | | 7/1990 |
| WO | 0101191 | A1 | 2/2001 |

OTHER PUBLICATIONS

International Preliminary Report on Patentability of PCT Application No. PCT/US2011/020632 dated Jul. 19, 2012.

* cited by examiner

DOWNHOLE DOWNLINKING SYSTEM EMPLOYING A DIFFERENTIAL PRESSURE TRANSDUCER

RELATED APPLICATIONS

None.

FIELD OF THE INVENTION

The present invention relates generally to a downhole downlinking system for receiving data and/or commands transmitted from the surface to a downhole tool deployed in a drill string. More particularly, exemplary embodiments of this invention relate to a downlinking system employing a differential transducer.

BACKGROUND OF THE INVENTION

Oil and gas well drilling operations commonly make use of logging while drilling (LWD) sensors to acquire logging data as the well bore is being drilled. This data may provide information about the progress of the drilling operation or the earth formations surrounding the well bore. Significant benefit may be obtained by improved control of downhole sensors from the rig floor or from remote locations. For example, the ability to send commands to downhole sensors that selectively activate the sensors can conserve battery life and thereby increase the amount of downhole time a sensor is useful.

Directional drilling operations are particularly enhanced by improved control. The ability to efficiently and reliably transmit commands from an operator to downhole drilling hardware may enhance the precision of the drilling operation. Downhole drilling hardware that, for example, deflects a portion of the drill string to steer the drilling tool is typically more effective when under tight control by an operator. The ability to continuously adjust the projected direction of the well path by sending commands to a steering tool may enable an operator to fine tune the projected well path based on substantially real-time survey and/or logging data. In such applications, both accuracy and timeliness of data transmission are clearly advantageous.

Prior art communication techniques that rely on the rotation rate of the drill string to encode data are known. For example U.S. Pat. No. 5,603,386 to Webster discloses a method in which the absolute rotation rate of the drill string is utilized to encode steering tool commands. U.S. Pat. No. 7,245,229 to Baron et al discloses a method in which a difference between first and second rotation rates is used to encode steering tool commands. U.S. Pat. No. 7,222,681 to Jones et al discloses a method in which steering tool commands and/or data may be encoded in a sequence of varying drill string rotation rates and drilling fluid flow rates. The varying rotation rates and flow rates are measured downhole and processed to decode the data and/or the commands.

While drill string rotation rate encoding techniques are commercially serviceable, there is room for improvement in certain downhole applications. For example, precise measurement of the drill string rotation rate can become problematic in deep and/or horizontal wells or when stick/slip conditions are encountered. Rotation rate encoding also commonly requires the drilling process to be interrupted and the drill bit to be lifted off bottom. Therefore, there exists a need for an improved downlinking system for downhole tools.

SUMMARY OF THE INVENTION

The present invention addresses the need for an improved downlinking system for downhole tools. Aspects of the invention include a downhole tool including a downlinking system deployed in a downhole tool body. The downlinking system includes a differential pressure transducer configured to measured a pressure difference between drilling fluid in an internal through bore and drilling fluid external to the tool (in the borehole annulus). The differential transducer is electrically connected with an electronic controller (e.g., deployed in a steering tool) that is configured to receive and decode pressure waveforms.

Exemplary embodiments of the present invention may advantageously provide several technical advantages. For example, the present invention tends to improve the reliability of downhole transmission in that that it does not require a rotation rate of the drill string to be measured. Moreover, exemplary embodiments of the present invention may be advantageously utilized while drilling and therefore tend to save valuable rig time. The use of a differential transducer also tends to increase signal to noise ratio and therefore tends to further improve the reliability of downhole transmission.

In one aspect the present invention includes a downhole tool. A downlinking system is deployed in a downhole tool body having an internal through bore. The downlinking system includes a differential transducer deployed in a pressure housing. The differential transducer is disposed to measure a pressure difference between drilling fluid in the through bore and drilling fluid external to the tool in a borehole annulus.

In another aspect the present invention includes a downhole tool. A pressure housing is deployed on a downhole tool body having an internal through bore. A differential transducer is deployed in the pressure housing. The differential transducer has first and second sides, the first side being in fluid communication with drilling fluid in the through bore. A compensating piston is deployed in a cavity in the pressure housing. The piston and the cavity define first and second fluid chambers. The first fluid chamber is in fluid communication with drilling fluid external to the tool in a borehole annulus. The second fluid chamber is in fluid communication with the second side of the differential transducer.

In still another aspect the present invention includes a string of downhole tools. The string of tools includes a downhole steering tool having an electronic controller and a downhole sub connected to the steering tool. The sub includes a pressure housing deployed on a downhole tool body having an internal through bore. A differential transducer having first and second sides is deployed in the pressure housing. The first side of the differential transducer is in fluid communication with drilling fluid in the through bore. The differential transducer is in electrical communication with the controller. A compensating piston is deployed in a cavity in the pressure housing. The piston and the cavity define first and second fluid chambers. The first fluid chamber is in fluid communication with drilling fluid external to the tool in a borehole annulus. The second fluid chamber is in fluid communication with the second side of the differential transducer. In one exemplary embodiment of the invention, the controller is configured to receive and decode a differential pressure waveform from the differential transducer.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
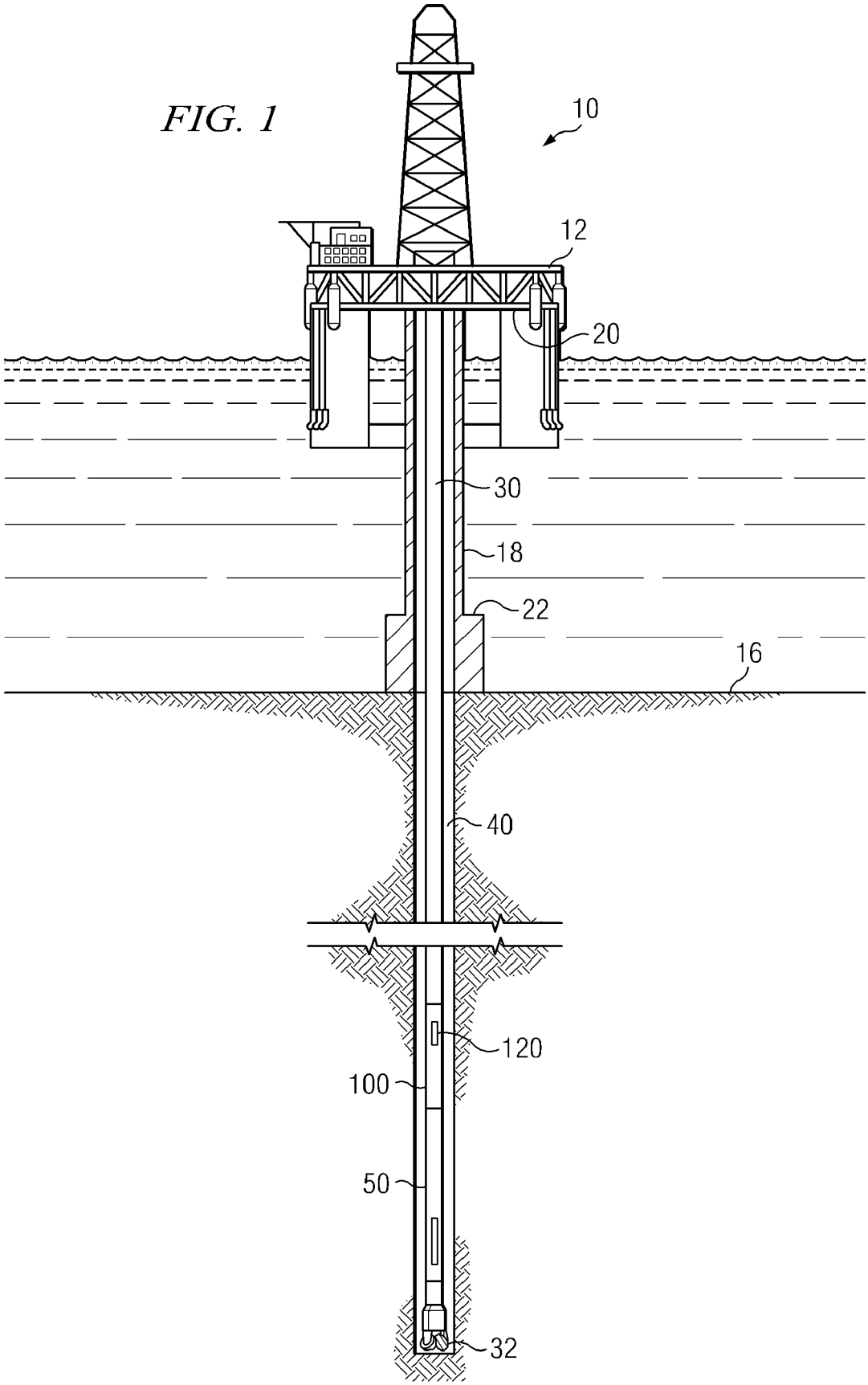
FIG. 1 depicts a drilling rig on which exemplary embodiments of the present invention may be deployed.

Referring first to FIGS. 1 through 5, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 5 may be described herein with respect to that reference numeral shown on other views.

FIG. 1 illustrates a drilling rig 10 suitable for the deployment of exemplary embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering the drill string 30, which, as shown, extends into borehole 40 and includes a drill bit 32, a steering tool 50, and a downhole tool 100 including a downlinking system 120 in accordance with the present invention. The downlinking system 120 may be in electronic communication, for example, with the steering tool 50 and may be disposed to receive encoded commands from the surface and transmit those encoded commands to the steering tool 50. The drill string 30 may also include various other electronic devices disposed to be in electronic communication with the downlinking system 120, e.g., including a telemetry system, additional sensors for sensing downhole characteristics of the borehole and the surrounding formation, and microcontrollers deployed in other downhole measurement tools. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore.

Figure 2A:
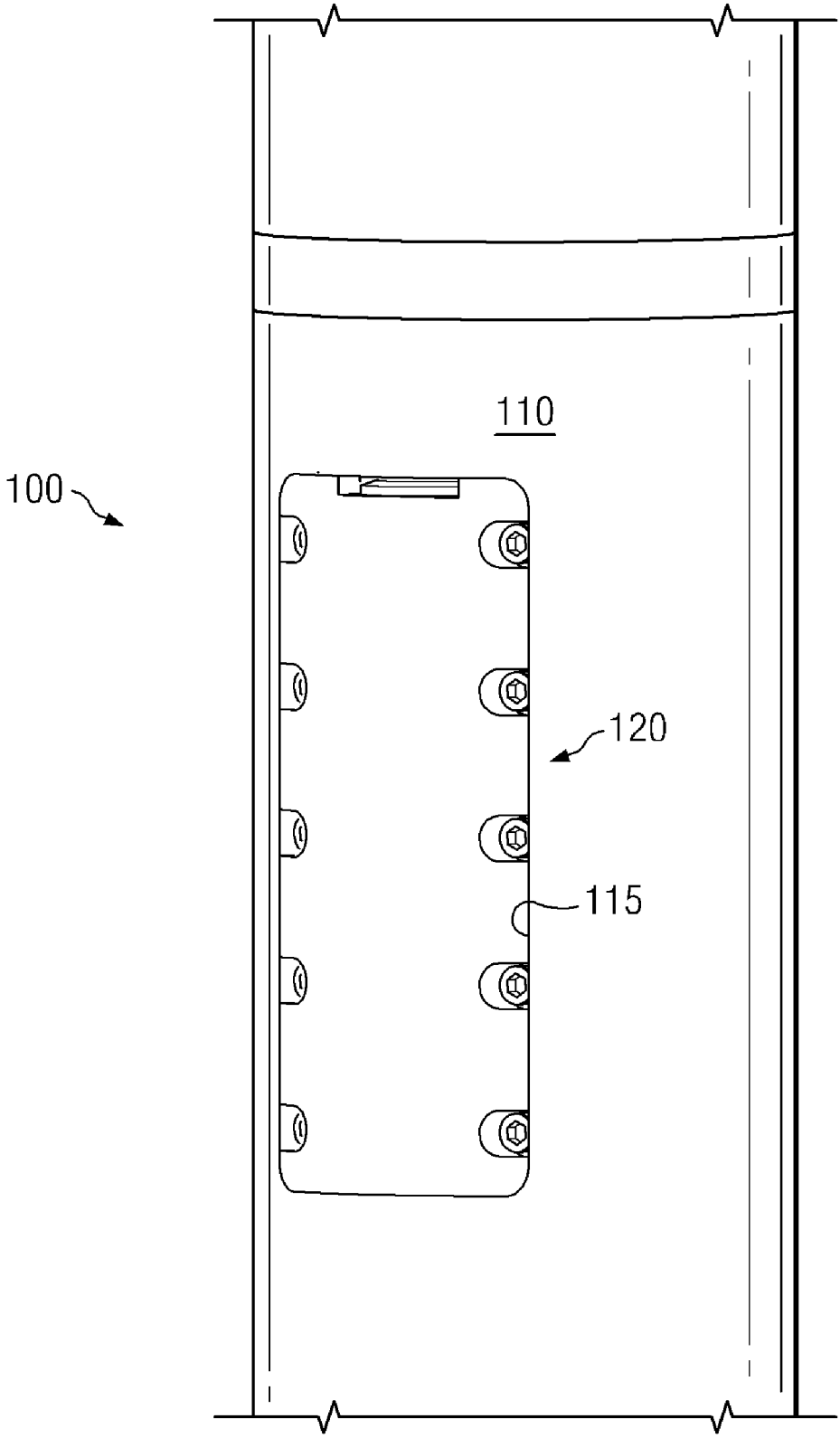
FIGS. 2A and 2B depict fully assembled and partially exploded views of a portion of the downhole tool shown on FIG. 1.
Figure 2B:
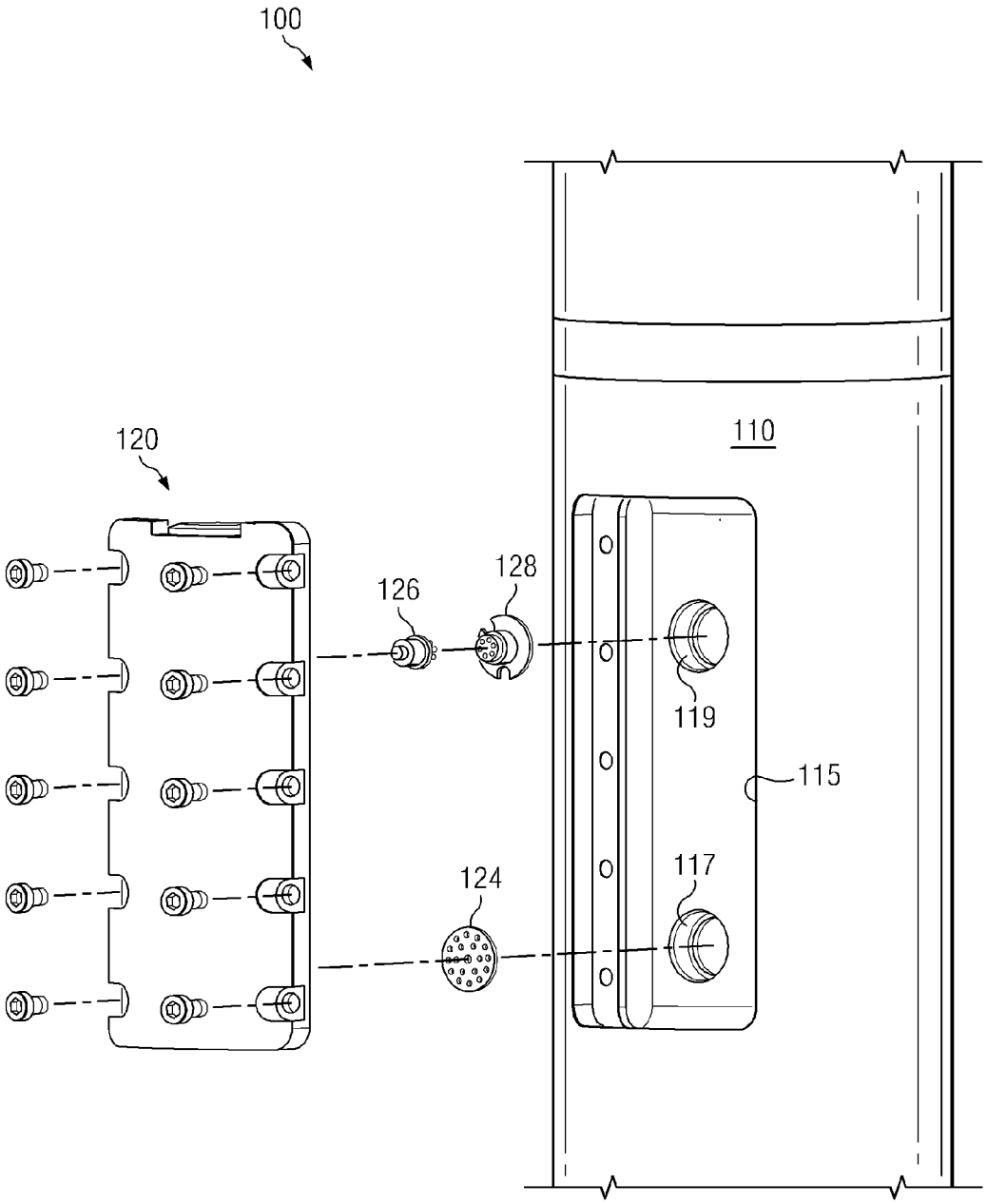

Turning now to FIGS. 2A and 2B, a portion of downhole tool 100 is depicted in perspective view. In the exemplary embodiment shown, downhole tool 100 includes a substantially cylindrical downhole tool body 110 having threaded ends (not shown) for connecting with the drill string. Downlinking system 120 is sealingly deployed in chassis slot 115. Chassis slot 115 includes first and second radial bores 117 and 119. Bore 117 provides for fluid communication with drilling fluid in the central bore 105 (FIG. 5) of the tool 100. A filter screen 124 is deployed in bore 115 to minimize ingress of drilling fluid particulate into the downlinking system 120. Bore 119 provides for electronic communication between the downlinking system 120 and other components in the drill string, e.g., via electrical connectors 126 and 128.

Downlinking system 120 is advantageously configured as a stand-alone assembly. By stand-alone it is meant that the downlinking system may be essentially fully assembled and tested prior to being incorporated into the downhole tool 100. This feature of the invention advantageously simplifies the assembly and testing protocol of the downlinking system 100 and therefore tends to improve reliability and reduce fabrication costs. This feature of the invention also tends to improve the serviceability of the tool 100 in that a failed system 120 (or simply one needing service) may be easily removed from the tool 100 and replaced and/or repaired. After assembly and testing, the downlinking system 120 may be deployed on a downhole tool body, for example, as depicted on FIG. 2A.

Figure 3:
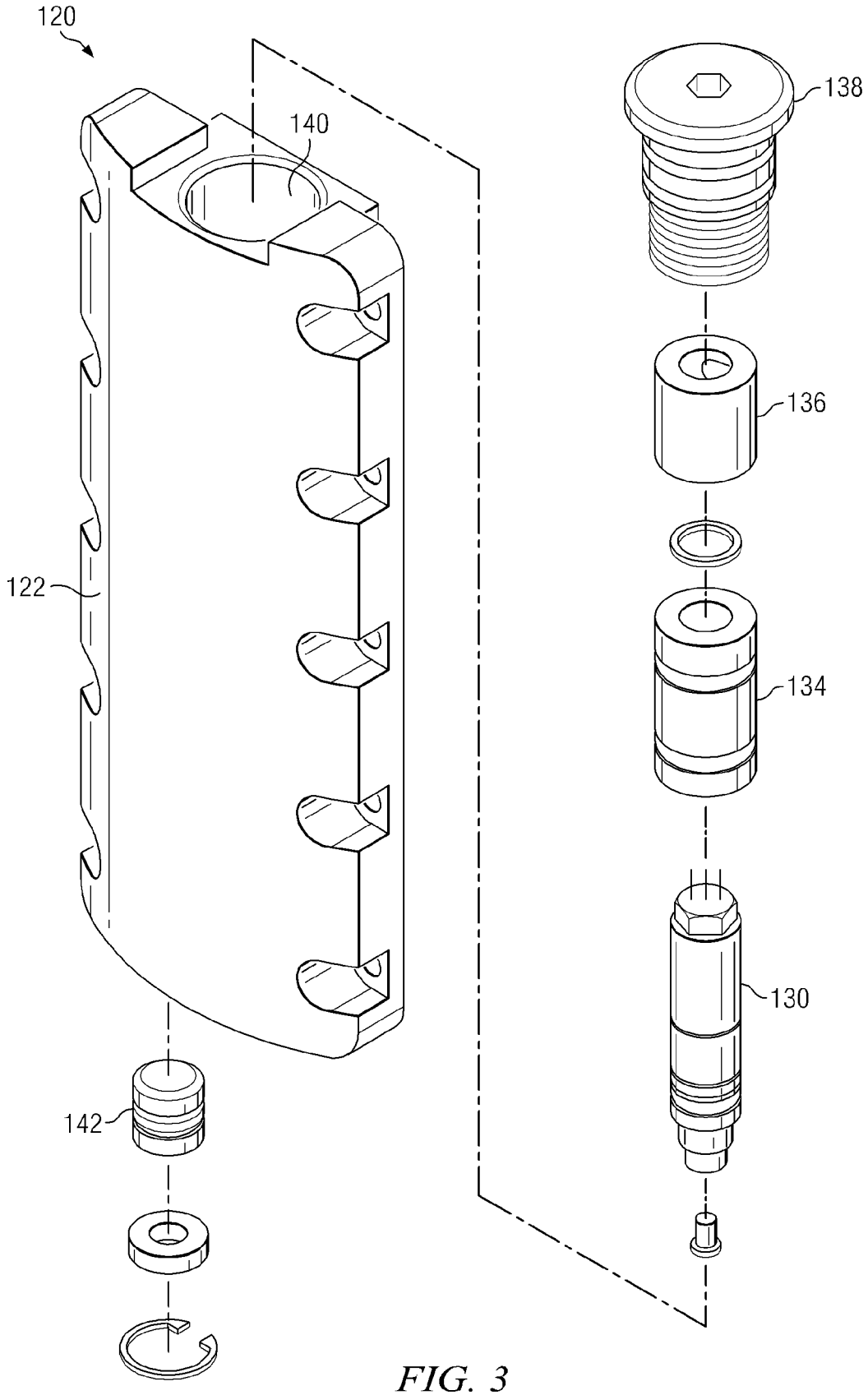
FIG. 3 depicts a longitudinally exploded view of one exemplary embodiment of a downlinking system in accordance with the present invention.

FIG. 3 depicts a longitudinally exploded view of downlinking system 120. As depicted, a differential pressure transducer 130 is deployed in a pressure housing 122. Substantially any suitable differential transducer 130 may be utilized, however, a differential transducer having a relatively low-pressure range (as compared to the drilling fluid pressure in the central bore of the tool 100) tends to advantageously increase the signal amplitude (and therefore the signal to noise ratio). For example, in one exemplary embodiment of the invention, a differential transducer having a differential pressure range from 0 to 1000 psi may be advantageously utilized.

In the exemplary embodiment depicted, the differential transducer 130 is deployed in a first longitudinal bore 140 in pressure housing 122. Differential transducer 130 is electrically connected with a pressure tight bulkhead 134, which is intended to prevent the ingress of drilling fluid from the differential transducer 130 into the electronics communication bore 119 (FIG. 2B). Bulkhead 134 is electrically connected with connector 126 through sleeve 136. A locknut 138 sealingly engages the open end of bore 140.

Figure 4:
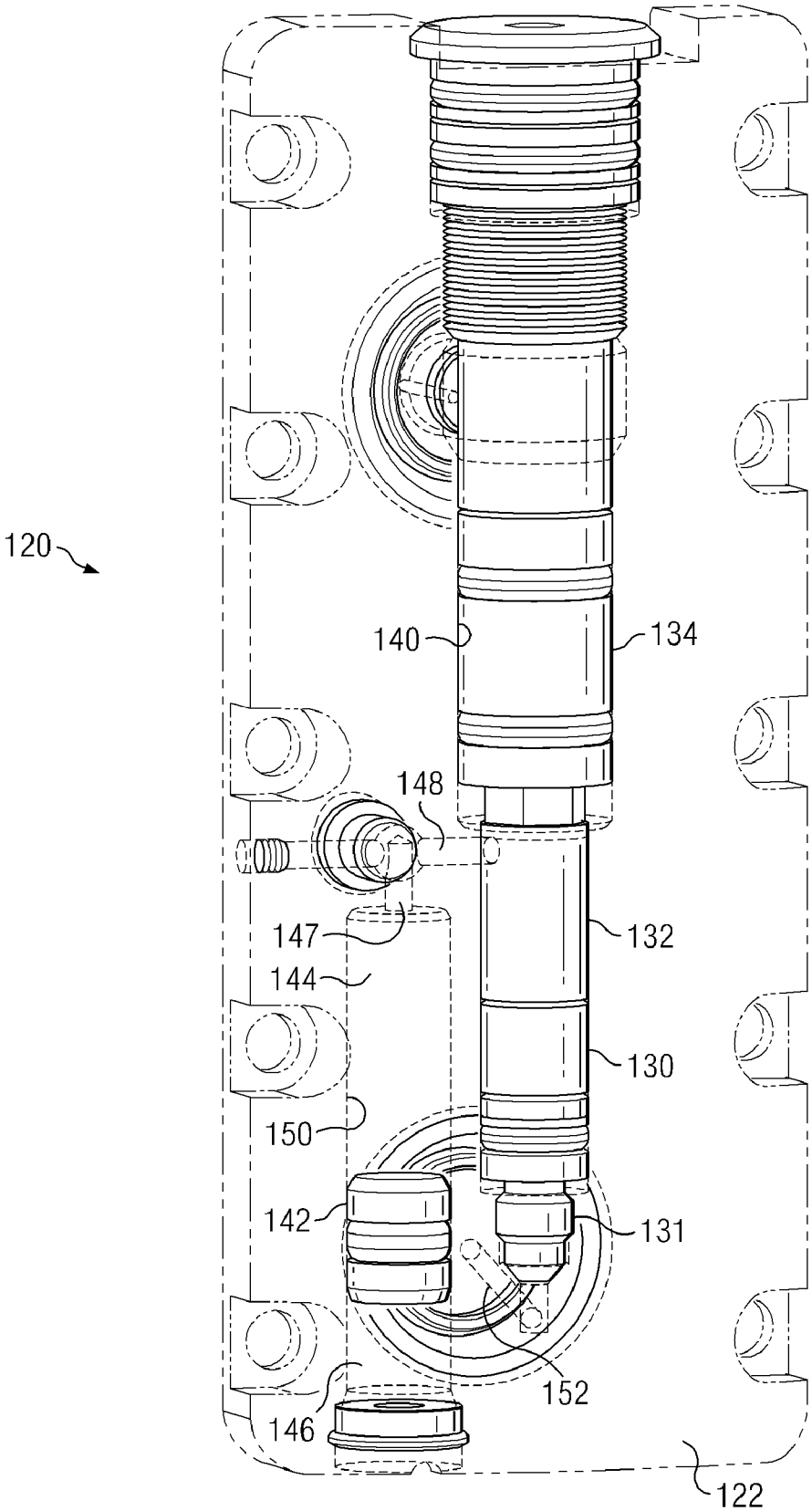
FIG. 4 depicts a fully assembled view of the downlinking system depicted in FIG. 3.

With continued reference to FIG. 3 and further reference now to FIG. 4, a compensating piston 142 is deployed in and sealingly engages a second longitudinal bore 150 in pressure housing 122. The bore 150 and piston 142 define first and second oil filled and drilling fluid filled fluid chambers 144 and 146. Chamber 146 is in fluid communication with drilling fluid in the borehole annulus (at hydrostatic well bore pressure). It will be readily understood to those of ordinary skill in the art that the drilling fluid in the borehole exerts a force on the compensating piston 142 proportional to the hydrostatic pressure in the borehole, which in turn pressurizes the hydraulic fluid in chamber 144.

Figure 5:
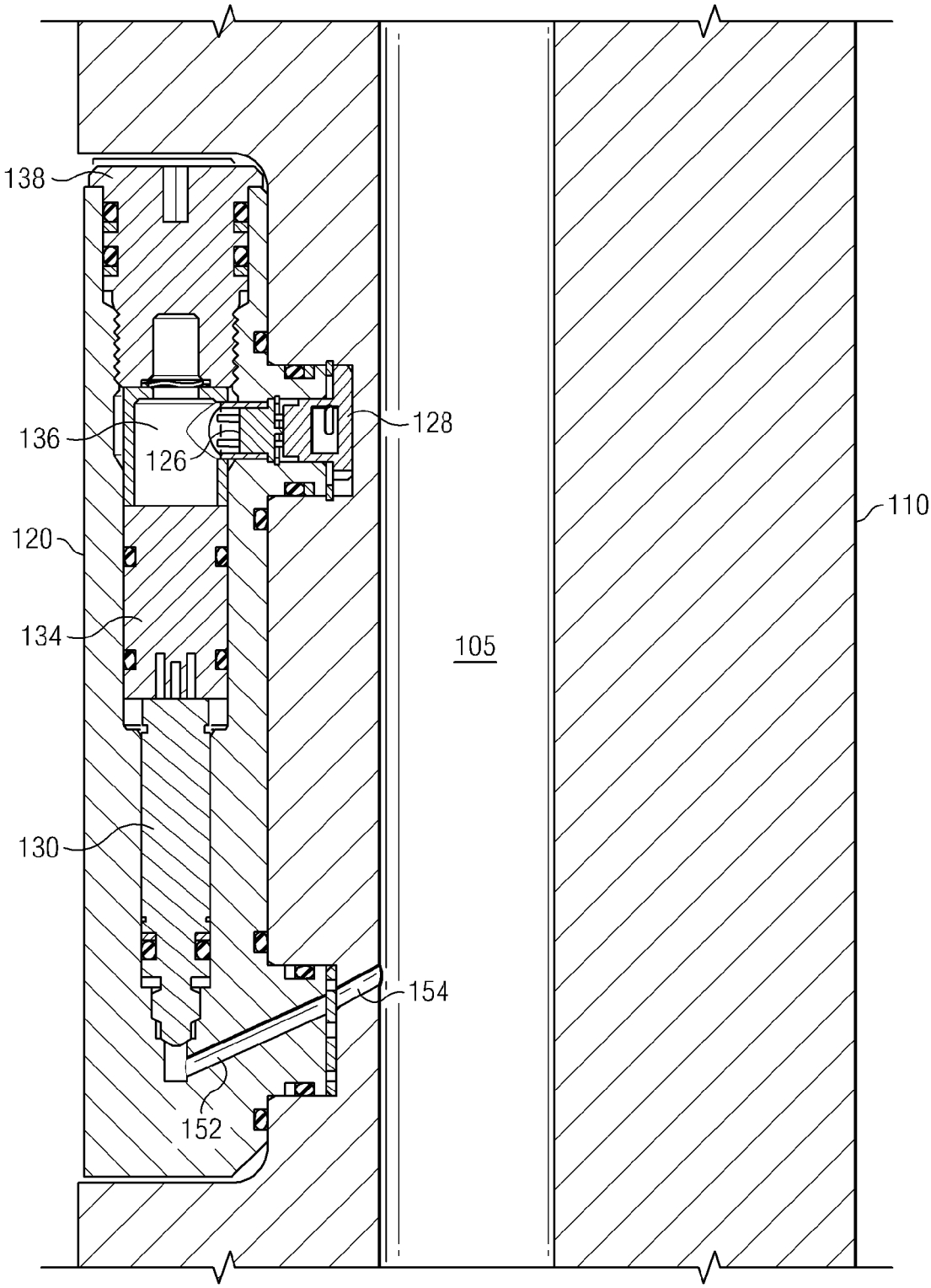
FIG. 5 depicts a longitudinal cross section of the exemplary embodiment depicted on FIG. 2A.

With reference now to FIGS. 4 and 5, differential transducer 130 is disposed to measure a difference in pressure between drilling fluid in through bore 105 (the central bore in the tool 100) and drilling fluid in the borehole annulus (hydrostatic pressure). Bore 152 in housing 122 and bore 154 in tool body 110 provide high pressure drilling fluid from the through bore 105 to a first side 131 (or front side) of the differential transducer 130. Bores 147 and 148 provide hydraulic oil (at hydrostatic pressure) to a second side 132 (or back side) of the differential transducer 130. The transducer 130 measures a pressure difference between these fluids (between the front and back sides of the differential transducer).

Figure 6A:
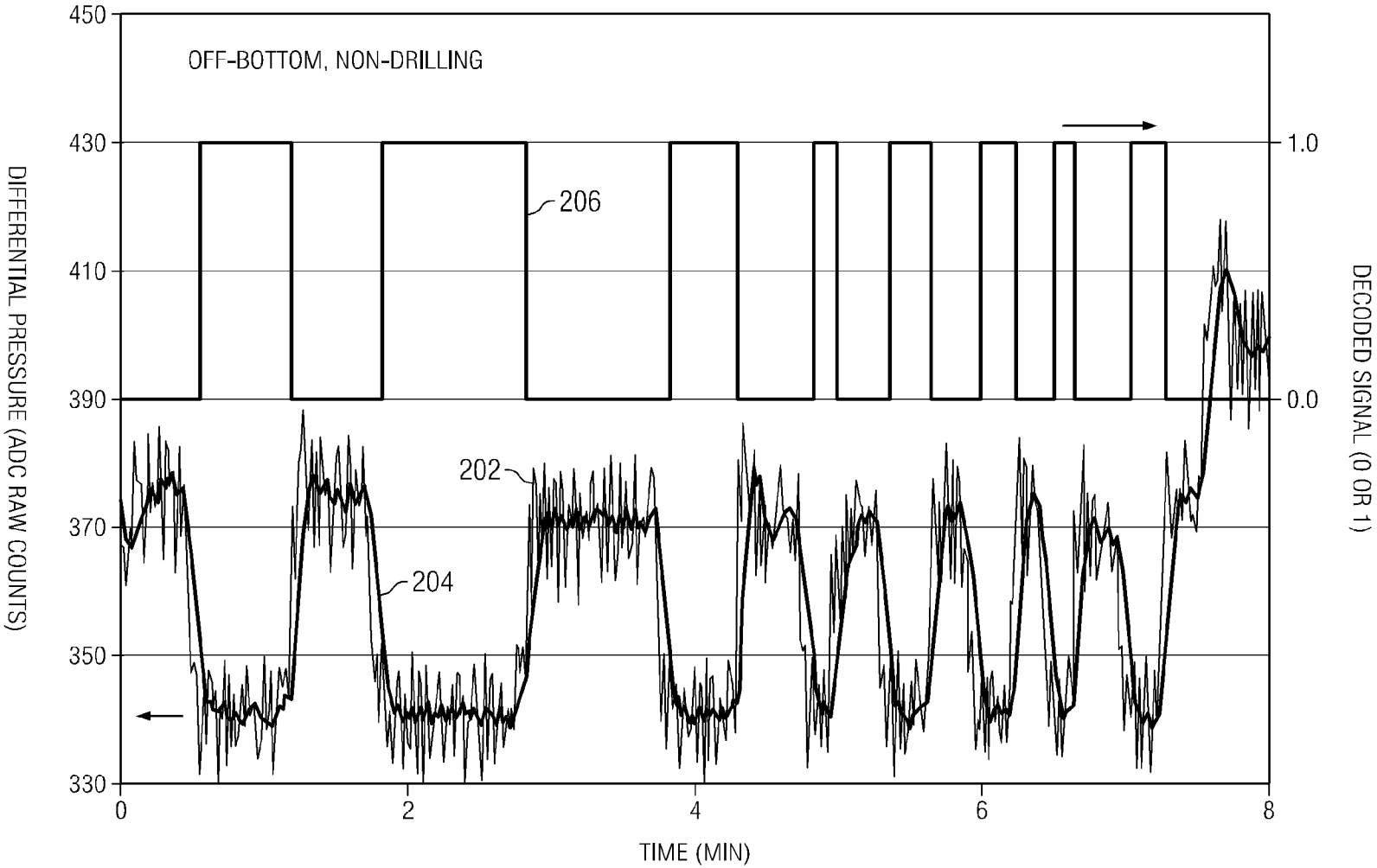
FIGS. 6A and 6B depict test data acquired in a downhole test.
Figure 6B:
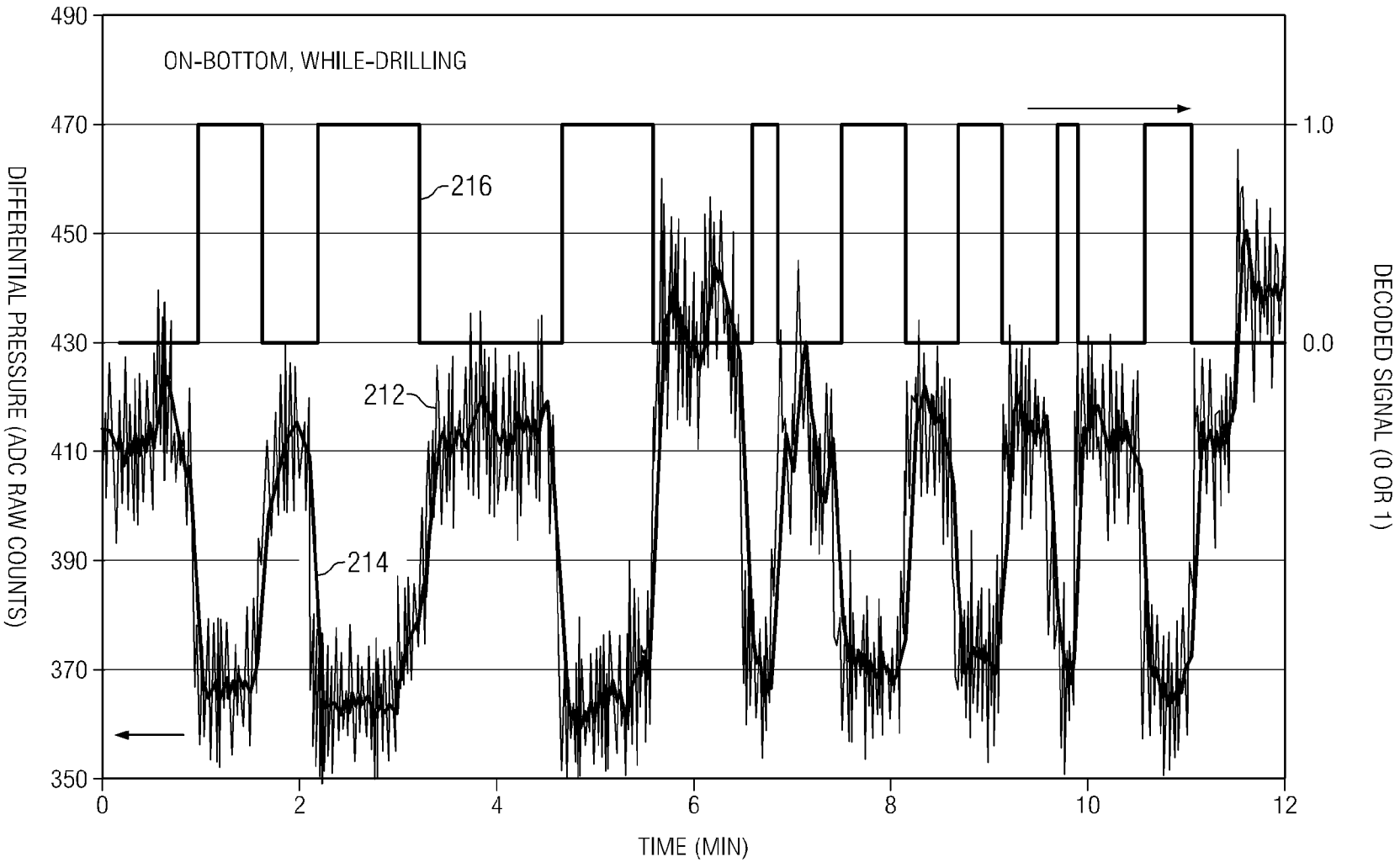

FIGS. 6A and 6B depict waveforms and decoded signals detected using the exemplary embodiment of the invention depicted on FIGS. 2 through 5. These examples were acquired during a downhole drilling operation in a test well in which negative pressure pulses were propagated downward through the mud column, e.g., via temporarily diverting fluid flow. In this example, the downlinking system was deployed in a battery sub located above a rotary steerable tool (e.g., as depicted on FIG. 1). The received waveforms (including a plurality of negative pressure pulses) were transmitted to a controller located in the steering tool. The waveforms were decoded at the steering tool. The invention is of course not limited in these regards.

FIG. 6A depicts a plot of differential pressure (in units of analog to digital converter counts) versus time for an example waveform 202 and 204 and decoded signal 206 acquired during an off-bottom, non-drilling test. The example waveform is shown using standard one second 202 and eight second 204 averaging. The decoded waveform 206 is in conventional binary form in which a high differential pressure is decoded as a '0' and a low differential pressure (the negative pressure pulse) is decoded as a '1'.

FIG. 6B depicts a plot of differential pressure (in units of analog to digital converter counts) versus time for an example waveform 212 and 214 and decoded signal 216 acquired during an on-bottom, while-drilling test. The example waveform is again shown using standard one second 212 and eight second 214 averaging. The decoded waveform 216 is in conventional binary form in which a high differential pressure is decoded as a '0' and a low differential pressure (the negative pressure pulse) is decoded as a '1'. FIGS. 6A and 6B demonstrate that pressure pulses may be readily received and decoded during both non-drilling and while-drilling operations using exemplary embodiments of the downlinking system of the present invention.

Although the present invention and its advantages have been described in detail, it should be understood that various changes, substitutions and alternations can be made herein without departing from the spirit and scope of the invention as defined by the appended claims.

We claim:

1. A downhole tool comprising:
a downhole tool body including an internal through bore;
a downlinking system deployed in the tool body, the downlinking system including a differential transducer deployed in a longitudinal bore in a pressure housing, the differential transducer disposed to measure a pressure difference between drilling fluid in the through bore and drilling fluid external to the tool in a borehole annulus, the downlinking system further including a pressure tight bulkhead deployed in the longitudinal bore, the bulkhead being electrically connected with the differential transducer.

2. The downhole tool of claim 1, wherein the downlinking system is configured as a stand alone assembly and sealing engages a chassis slot formed in an outer surface of the tool body.

3. The downhole tool of claim 1, further comprising a compensating piston deployed in a cavity in the pressure housing, the piston and cavity defining first and second fluid chambers, the first fluid chamber being in fluid communication with drilling fluid external to the tool in a borehole annulus.

4. The downhole tool of claim 3, wherein the differential transducer comprises first and second sides, the first side in fluid communication with drilling fluid in the through bore and the second side in fluid communication with hydraulic oil in the second fluid chamber.

5. The downhole tool of claim 1, being connected to a second downhole tool such that the differential transducer is electrically connected with an electronic controller deployed in the second downhole tool, the controller being configured to receive and decode a differential pressure waveform from the differential transducer.

6. A downhole tool comprising:
a downhole tool body including an internal through bore;
a pressure housing deployed on the tool body;
a differential transducer deployed in the pressure housing, the differential transducer having first and second sides, the first side of the differential transducer being in fluid communication with drilling fluid in the through bore;
a compensating piston deployed in a cavity in the pressure housing, the piston and the cavity defining first and second fluid chambers, the first fluid chamber being in fluid communication with drilling fluid external to the tool in a borehole annulus, the second fluid chamber being in fluid communication with the second side of the differential transducer; and
wherein a first bore formed in the tool body and a second bore formed in the pressure housing provide the fluid communication between the through bore and the first side of the differential transducer.

7. The downhole tool of claim 6, wherein at least one bore formed in the pressure housing provides the fluid communication between the second fluid chamber and the second side of the differential transducer.

8. The downhole tool of claim 6, wherein the differential transducer is deployed in a longitudinal bore formed in the pressure housing.

9. The downhole tool of claim 8, further comprising a pressure tight bulkhead deployed in the longitudinal bore, the bulkhead being electrically connected to the differential transducer.

10. The downhole tool of claim 9, further comprising a sealed locknut deployed at a longitudinal end of the longitudinal bore, the bulkhead being deployed between the differential transducer and the locknut.

11. The downhole tool of claim 6, wherein the differential transducer is electrically connected with an electronic controller, the controller being configured to receive and decode a differential pressure waveform from the differential transducer.

12. The downhole tool of claim 6, wherein the second fluid chamber is filled with hydraulic oil.

13. A string of downhole tools comprising:
a downhole steering tool including an electronic controller; and
a downhole sub connected to the steering tool, the sub including:
a downhole tool body including an internal through bore;
a pressure housing deployed on the tool body;
a differential transducer deployed a longitudinal bore in the pressure housing, the differential transducer having first and second sides, the first side of the differential transducer being in fluid communication with drilling fluid in the through bore, the differential transducer being in electrical communication with the controller;
a compensating piston deployed in a cavity in the pressure housing, the piston and the cavity defining first and second fluid chambers, the first fluid chamber being in fluid communication with drilling fluid external to the tool in a borehole annulus, the second fluid chamber being in fluid communication with the second side of the differential transducer; and wherein the tool further comprises a pressure tight bulkhead deployed in the longitudinal bore, a first end of the bulkhead being connected with the differential transducer, a second end of the bulkhead being electrically connected with the controller.

14. The string of tools of claim 13, wherein the controller is configured to receive a differential pressure waveform from the differential transducer.

15. The string of tools of claim 14, wherein the controller is further configured to decode the differential pressure waveform.

16. The string of tools of claim 15, wherein the controller is configured to decode the differential pressure waveform to a binary waveform such that a negative pressure pulse in the differential pressure waveform is decoded as a '1'.

17. The string of tools of claim 13, wherein the pressure housing sealingly engages a corresponding chassis slot formed in an outer surface of the tool body.

18. A downhole tool comprising:

a downhole tool body including an internal through bore;

a pressure housing deployed on the tool body;

a differential transducer deployed in the pressure housing, the differential transducer having first and second sides, the first side of the differential transducer being in fluid communication with drilling fluid in the through bore;

a compensating piston deployed in a cavity in the pressure housing, the piston and the cavity defining first and second fluid chambers, the first fluid chamber being in fluid communication with drilling fluid external to the tool in a borehole annulus, the second fluid chamber being in fluid communication with the second side of the differential transducer; and wherein at least one bore formed in the pressure housing provides the fluid communication between the second fluid chamber and the second side of the differential transducer.

* * * * *